United States Patent [19]

Drogos

[11] Patent Number: 5,027,973

[45] Date of Patent: Jul. 2, 1991

[54] CONTAINER HAVING INTEGRALLY FORMED BAIL HINGE AND REINFORCING RING

[75] Inventor: Donald J. Drogos, Bolingbrook, Ill.

[73] Assignee: The Valspar Corporation, Minneapolis, Minn.

[21] Appl. No.: 389,347

[22] Filed: Aug. 3, 1989

[51] Int. Cl.[5] ..... B65D 25/28

[52] U.S. Cl. ..... 220/657; 220/659; 220/91; 220/94 A

[58] Field of Search ..... 220/91, 94 A, 94 R, 220/657, 659

[56] References Cited

U.S. PATENT DOCUMENTS

| | | | |
|---|---|---|---|
| 3,000,527 | 9/1961 | Jennings et al. | 220/94 R |
| 3,119,541 | 1/1964 | Lynn | 220/94 A |
| 3,623,633 | 11/1971 | Kinn | 220/84 R |
| 3,756,451 | 9/1973 | Popeil | 220/94 R |
| 3,889,732 | 6/1975 | Wilkins | 220/94 A |

*Primary Examiner*—Joseph Man-Fu Moy

*Attorney, Agent, or Firm*—James R. Haller; Edward S. Hotchkiss

[57] ABSTRACT

A container, such as a pail for holding paint or the like, integrally molded from a resilient plastic material. The container includes an integrally molded bail having ends joined to wall portions of the container by relatively thin, flexible, diametrically opposed hinge portions which enables the container and its liquid contents to hang vertically from the bail. A stiffening bead is provided circumferentially about the wall of the container adjacent its upper rim, the bead including a vertically extending, X-shaped lattice structure included between the wall of the container and a wall spaced annularly thereabout.

6 Claims, 3 Drawing Sheets

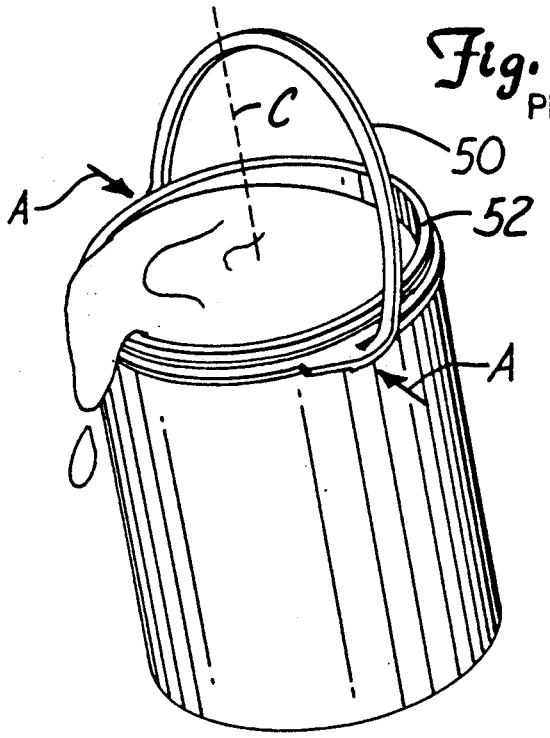
Fig. 1
PRIOR ART
Fig. 2
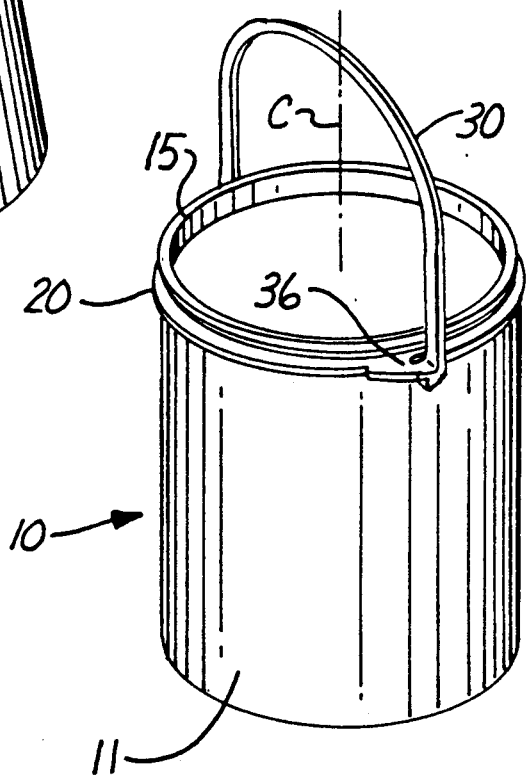
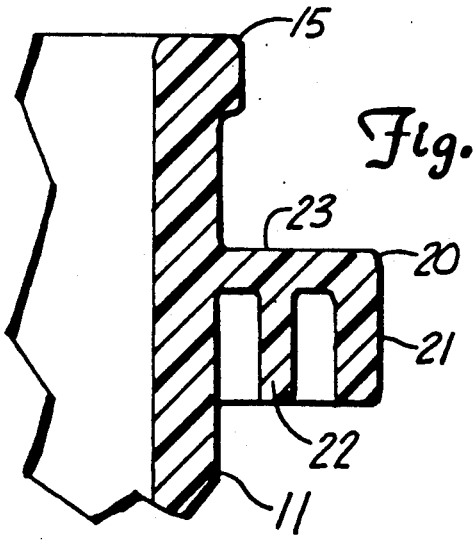
Fig. 5
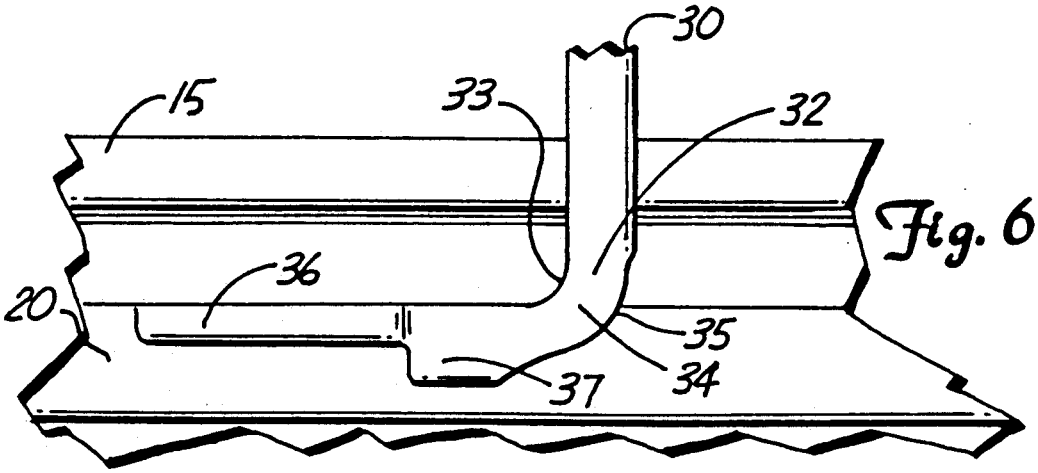
Fig. 6

CONTAINER HAVING INTEGRALLY FORMED BAIL HINGE AND REINFORCING RING

BACKGROUND

Paint and other liquids commonly are stored and sold in metal pails having separately formed wire bails or handles rotatably attached to the pail sides. The rotatable wire bail allows the containers to hang substantially perpendicular to the ground so that the contents are not spilled when the bail is placed over a ladder hook or other support. Some effort has been made to utilize plastics for such containers. U.S. Pat. No. 4,380,304, Anderson, discloses a plastic container having an integral handle and a design suitable for stacking filled containers one upon another. However, the prior art plastic containers with integrally formed bails do not hang properly when suspended by their bails, due at least in part to the stiffness of the bails. Also, due to the resiliency of their plastic walls, such plastic pails tend to deform under the weight of their liquid contents when so suspended, resulting in unintended spillage of liquid.

SUMMARY OF THE INVENTION

The instant invention provides a plastic container with an integrally formed bail and connecting hinge and which is particularly useful for storing paints and like liquids. The container is integrally molded of a resilient plastic and has a floor and walls defining an upwardly-open cavity preferably circular in cross-section and with a vertical axis and an upper rim. A bail lying normally in a generally horizontal plane is joined to the container adjacent the rim, the bail having hinge means comprising resilient portions of reduced thickness adjacent each end of the bail and diametrically opposed to one another on opposite sides of the container. The hinge means are so formed as to enable the bail to be swung upwardly into a container-supporting position with the axis of the container passing vertically upwardly through the bail. In this manner, the container is permitted to hang substantially vertically when suspended by its bail, thereby avoiding the difficulty in prior art plastic containers of suspending a full container by its handle without having the contents spill out.

In a further embodiment, the container as thus described is provided with an external circumferential stiffening bead or ring adjacent its rim, the bead desirably comprising a first, generally vertical wall congruent to but spaced outwardly from the wall of the container and a second wall extending between and joining the first wall to the wall of the container. The bead includes support means comprising a plurality of generally X shaped structural webs each extending vertically between the first wall and the wall of the container and joined at its ends to the last-mentioned walls.

BRIEF DESCRIPTION OF THE DRAWINGS

FIG. 1 is a perspective view of a prior art container with an integrally formed bail;

FIG. 2 is a perspective view of a container in accordance with the present invention;

FIG. 5 is an enlarged broken-away view in partial cross-section showing an upper portion of the container of FIG. 2;

FIG. 6 is an enlarged broken away view of the hinge portion shown also in FIG. 4 when the bail is in an upright position, as when the bail is used to suspend the container;

DETAILED DESCRIPTION

Figure 3:
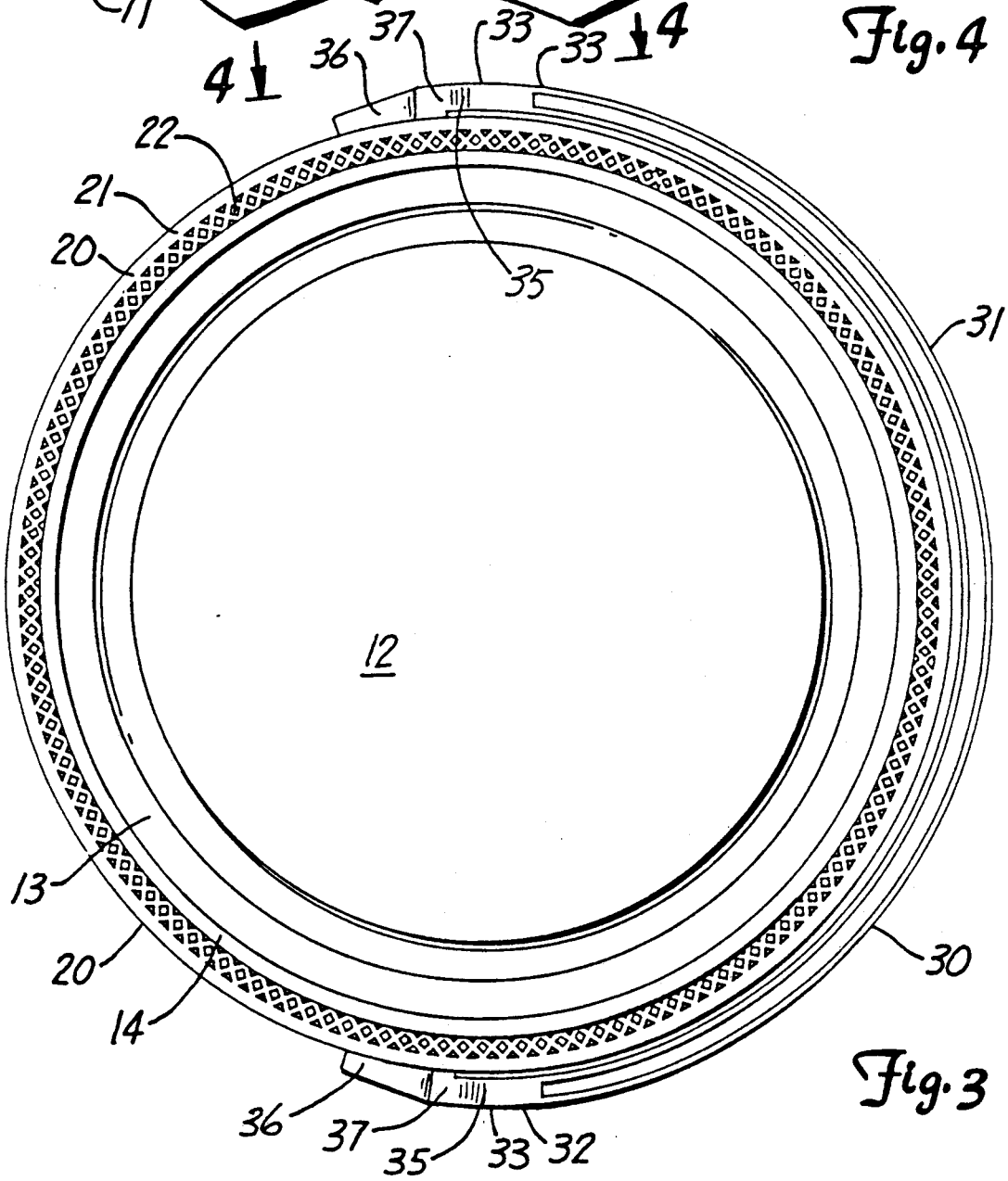
FIG. 3 is a bottom view of the container of FIG. 2.

Referring first to FIG. 2, a container of the invention is shown with a circumferential support bead 20 and a bail 30. The container 10 includes an outer cylindrical wall 11 terminating at its open end in a rim 15 designed in a known manner to mechanically receive a cover (not shown) for the container. Referring to FIG. 3, the container also includes a bottom or floor 12 which is integrally formed with the side wall 11 and is disposed slightly above the bottom end of the side wall, creating a bottom rim portion 14. If so desired, the floor may also include a stiffening circumferential groove 13, which is spaced a short distance radially inwardly from the bottom rim 14 and protrudes into the interior of the container. This groove may be configured to mate with a similar configuration formed on the upper side of the container's cover to facilitate stacking of filled containers for storage and shipping.

A support bead 20 is disposed slightly below the rim 15 on the outer surface of side wall 11. The support bead comprises an annular upper wall 23 which is formed integrally with the vertical side wall 11 (best seen in FIG. 5), a circumferentially extending generally vertical outer wall 21 spaced radially outwardly from the side wall 11, and a structural support lattice 22 disposed in the circumferential cavity formed by the side wall 11, the upper wall 23, and the outer wall 21. The support lattice is preferably comprised of a series of generally X-shaped structural webs extending vertically downwardly from upper wall 23 and terminating substantially even with the lower edge of outer wall 21. These X-shaped webs are contiguous so that they form a continuous, generally diamond shaped lattice structure as shown in FIG. 3. The individual webs forming each X desirably intersect at right angles. This lattice structure, which includes triangular elements, greatly enhances the structural rigidity of the container at its upper end and, in combination with the support provided by the floor 12, provides the container with substantial resistance to deformation and potential overflow of the contents of the container when the container is hung from the bail.

Figure 7:
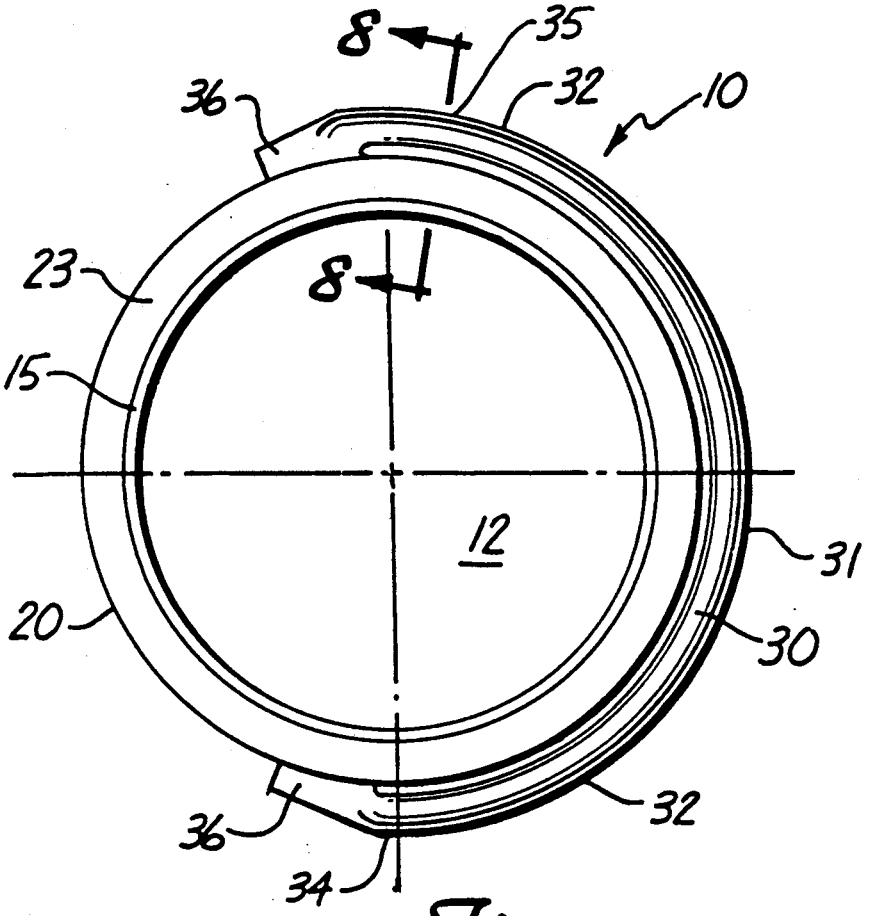
FIG. 7 is a plan view of the container of FIG. 2.
Figure 8:
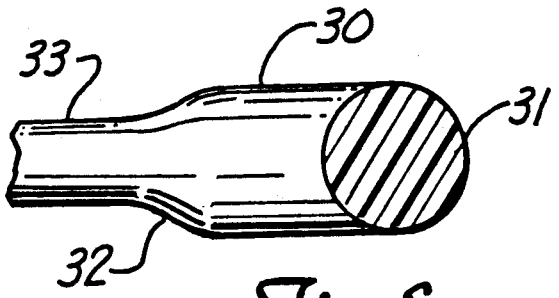
FIG. 8 is a broken-away, cross-sectional view taken along line 8—8 of FIG. 7.

The bail 30 is integrally formed with the container. The bail includes a manually graspable central portion 31, two identical, generally horizontally extending bosses 36 which are formed as extensions of the upper wall 23 of the support bead 21 on opposite sides thereof, and identical flexible hinge portions 33 disposed between the central portion and the bosses. The bail desirably is formed in a horizontal plane (when the container is viewed as upright) substantially parallel to the upper wall of the support bead 23, the bail being generally congruent to the confronting wall 21 of the bead 20. The central portion 31 of the bail may be of any desired cross-sectional configuration and is shown as having a strap-like configuration that is generally rectangular in cross-section in FIGS. 2–4 and 6. Preferably, however, the central portion is generally circular in cross-section as shown in FIGS. 7 and 8 to present a rounded surface that can comfortably be held in the hand when the container is supported by the bail without having sharp edges of the bail bite into the hand. Referring particularly to FIGS. 7 and 8, this central portion is desirably solid in cross-section. As will be evident from these figures, this construction results in the central portion of the bail having a significantly greater cross-sectional thickness than adjacent portions of the container. The bail may, if so desired, also include a central notch for centering it on a hook or other support when the container is in use. The notch is formed on the inner surface of the bail, substantially equidistant from the bosses 36.

Figure 4:
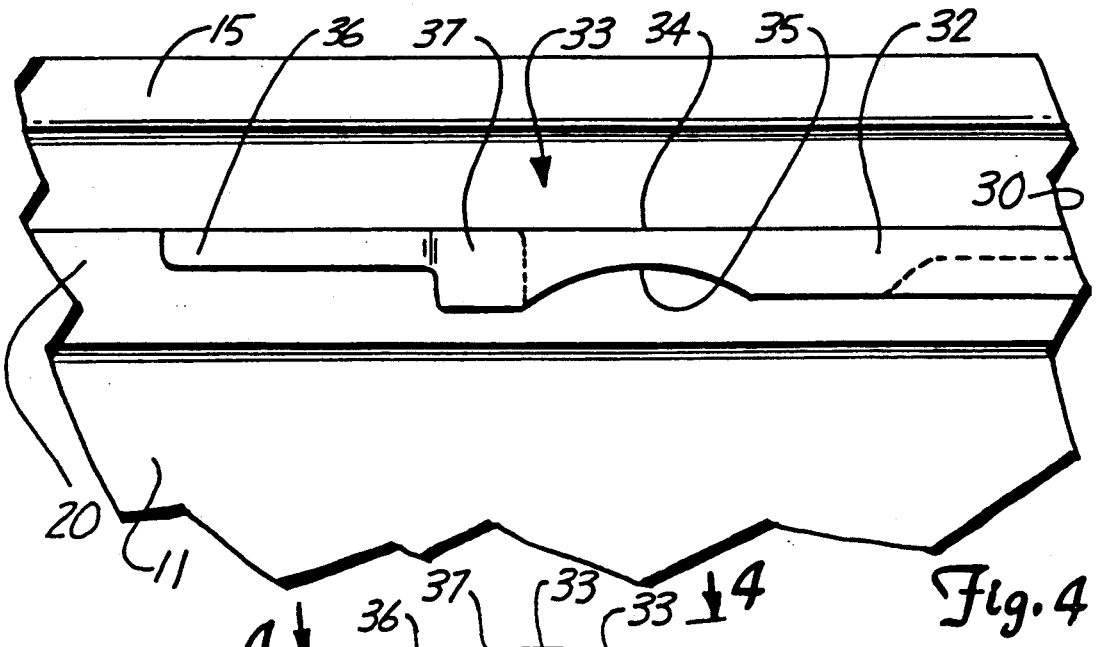
FIG. 4 is an enlarged broken-away view of the hinge portion of the container in FIG. 3 taken along line 4—4 of FIG. 3.

The hinge portions 33 formed at the respective ends of the bail have flexible portions 34 which are disposed on diametrically opposite sides of the container, and normally lie in a plane substantially parallel to the support bead's upper wall 21 when the bail is in a horizontal plane. Referring to FIG. 4, each hinge portion 33 includes a transition segment 32 adjacent its flexible portion 34. This transition segment is preferably solid so that it provides a strong connection between the manually graspable central portion of the bail and the flexible portion 34; it may be larger in cross-section than the manually graspable portion of the bail, as shown, or it may be of any appropriate thickness which provides the necessary strength. The flexible portion 34 abuts the transition member 32 and is formed with an arcuate underside 35 which gives the flexible portion a variable thickness which is at its thinnest near the middle of its length. In the preferred embodiment of FIGS. 7 and 8, the cross-sectional configuration of the bail changes from generally rectangular at the location of the hinge portions 33 to generally circular at its central portion 31, the change in cross-section occurring in the transition segment 32.

As best seen in FIG. 6, when the bail is lifted into an upright position, the thin, flexible portion 34 presents an area of preferred sharp bending, e.g., about a radius of not greater than about ¼ inches and preferably not greater than about 1/16 inches. Thus, the bail can be swung through a right angle into a substantially vertical plane. In this position, depicted in FIG. 2, a center line "C" along the axis of the container passes generally vertically through or very near the center of gravity of the container, the center of gravity of the contents of the container, and through the upper part of the bail.

Each boss 36 may include an area of increased thickness and width at its end that abuts the hinge portion 33 to define a connector 37 providing a strong connection between the rest of the bail and the support bead. As seen in FIG. 3, the end of each boss 36 is wider than the hinge portion so that the boss extends from the outer edge of the bail to the support bead to provide a space between the boss and the support bead, insuring that the boss is freely pivotable upwardly and downwardly about the hinge portions.

Referring now to FIGS. 1 and 2, the advantage of a hinged integral bail in a container of this invention over conventional bails known in the prior art is readily apparent. Prior art containers with integrally formed handles typically have bails of substantially uniform thickness and stiffness. When one suspends a filled container of this type by its bail 50, as shown in exaggerated form in FIG. 1, the axis "C" of the container does not pass through the bail; that is, because of the stiffness of the bail, neither the bail nor the axis of the container is vertical. As a result, the upper rim 52 lies in a plane tilted slightly with respect to the horizontal, and this result, coupled with inward movement of the sides of the container at its top as shown by arrows "A" in FIG. 1, may allow a portion of the contents of the container to spill over the edge. In the present invention, the problem is solved by providing the bail with specifically located flexible hinges that enable the bail to be bent sharply upward, and by providing a stiff circumferential bead adjacent the rim that resists deformation. As shown in FIG. 2, the center line "C" of the container passes through or very nearly through the bail when the container is nearly full; that is, the weight of the container and its contents exert sufficient gravatational force to deform the bail into this position. Thus, the upper rim 15, which is maintained generally circular by the bead 20, lies in a substantially horizontal plane and the contents of the container are less likely to spill.

While a preferred embodiment of the present invention has been described, it should be understood that various changes, adaptations, and modifications may be made therein without departing from the spirit of the invention and the scope of the impended claims.

I claim:

1. A container for paint or the like integrally molded of a resilient plastic and having a floor and walls defining an upwardly-open cavity having a vertical axis and upper rim and a stiffening bead extending peripherally around the container adjacent its rim and comprising a first, generally vertical wall congruent to but spaced outwardly from the wall of the container, a second wall joining the first wall to the wall of the container, and support means comprising a plurality of generally X-shaped structural webs each extending vertically between the first wall and the wall of the container and joined at its ends to the last-mentioned walls.

2. The container of claim 1 wherein each X-shaped structure is contiguous to neighboring X-shaped structures to form diamond-shaped included openings therewith.

3. The container of claim 1 wherein each X-shaped structure comprises a pair of crossing webs, the webs crossing at right angles to each other.

4. A container for paint or the like integrally molded of a resilient plastic and having a floor and walls defining an upwardly-open cavity having a vertical axis and an upper rim, a bail having a cross-sectional thickness significantly greater than that of adjacent portions of the container, the bail lying generally in a horizontal plane and joined to the container adjacent the rim, the bail having hinge means enabling it to be swung upwardly into a container-supporting position, the container including a stiffening bead extending peripherally around the container adjacent its rim and comprising a first, generally vertical wall congruent to but spaced outwardly from the wall of the container, a second wall joining the first wall to the wall of the container, and support means comprising a plurality of generally X-shaped structural webs each extending vertically between the first wall and the wall of the container and joined at its ends to the last-mentioned walls.

5. The container of claim 4 including bosses extending outwardly from the bead, said hinge means being attached to the bosses.

6. The container of claim 4 wherein said bail cross-sectional area is circular in configuration.

* * * * *